US009926818B2

(12) United States Patent
Asahi et al.

(10) Patent No.: US 9,926,818 B2
(45) Date of Patent: Mar. 27, 2018

(54) VALVE OPENING AND CLOSING TIMING CONTROL APPARATUS

(71) Applicant: AISIN SEIKI KABUSHIKI KAISHA, Kariya-shi, Aichi (JP)

(72) Inventors: Takeo Asahi, Kariya (JP); Yuji Noguchi, Obu (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 68 days.

(21) Appl. No.: 15/118,233

(22) PCT Filed: Feb. 13, 2015

(86) PCT No.: PCT/JP2015/053902
§ 371 (c)(1),
(2) Date: Aug. 11, 2016

(87) PCT Pub. No.: WO2015/129477
PCT Pub. Date: Sep. 3, 2015

(65) Prior Publication Data

US 2017/0183984 A1 Jun. 29, 2017

(30) Foreign Application Priority Data

Feb. 27, 2014 (JP) ..... 2014-037287

(51) Int. Cl.
*F01L 1/344* (2006.01)
*F01L 1/047* (2006.01)
*F01L 1/46* (2006.01)

(52) U.S. Cl.
CPC ..... *F01L 1/3442* (2013.01); *F01L 1/047* (2013.01); *F01L 1/46* (2013.01);
(Continued)

(58) Field of Classification Search
CPC ..... F01L 2001/3443; F01L 2001/34433; F01L 1/46; F01L 2101/00
(Continued)

(56) References Cited

U.S. PATENT DOCUMENTS 6,363,896 B1 4/2002 Speier
2001/0017116 A1 8/2001 Eguchi
(Continued)

FOREIGN PATENT DOCUMENTS

DE 10 2008 057 492 A1 5/2010
EP 1 672 184 A1 6/2006
(Continued)

OTHER PUBLICATIONS

European Search Report dated Mar. 10, 2017, by the European Patent Office, in corresponding European Patent Application No. 15754571.6. (9 pages).
(Continued)

*Primary Examiner* — Jorge Leon, Jr.
(74) *Attorney, Agent, or Firm* — Buchanan Ingersoll & Rooney PC

(57) ABSTRACT

A valve opening and closing timing control apparatus includes a driven-side rotational member connected to a camshaft by a mounting member, a spool movably provided at an inner portion of a tubular wall portion of the mounting member, a first flow passage connecting a first port of the tubular wall portion and the advanced angle chamber to each other and a second flow passage connecting a second port of the tubular wall portion and the retarded angle chamber to each other, the first flow passage and the second flow passage being provided at the driven-side rotational member. A thermal expansion coefficient of a material forming
(Continued)

the driven-side rotational member is greater than a thermal expansion coefficient of a material forming the mounting member.

9 Claims, 11 Drawing Sheets

(52) U.S. Cl.
CPC ..... *F01L 2001/3443* (2013.01); *F01L 2001/3445* (2013.01); *F01L 2001/34433* (2013.01); *F01L 2101/00* (2013.01)

(58) Field of Classification Search
USPC ..... 123/90.17
See application file for complete search history.

(56) References Cited

U.S. PATENT DOCUMENTS

2002/0038501 A1 4/2002 Iwasaki et al.
2002/0139330 A1* 10/2002 Takahashi ..... F01L 1/022 123/90.17
2003/0230269 A1 12/2003 Simpson et al.
2006/0130789 A1 6/2006 Smith
2009/0090321 A1* 4/2009 Kleiber ..... F01L 1/3442 123/90.17
2012/0060779 A1 3/2012 Adachi et al.

FOREIGN PATENT DOCUMENTS

EP 2 690 261 A2 1/2014
JP 2004019664 A 1/2004
JP 4013364 B2 11/2007
JP 4032284 B2 1/2008
JP 2012057578 A 3/2012

OTHER PUBLICATIONS

International Search Report (PCT/ISA/210) dated May 19, 2015, by the Japanese Patent Office as the International Searching Authority for International Application No. PCT/JP2015/053902.
Written Opinion (PCT/ISA/237) dated May 19, 2015, by the Japanese Patent Office as the International Searching Authority for International Application No. PCT/JP2015/053902.

* cited by examiner

VALVE OPENING AND CLOSING TIMING CONTROL APPARATUS

TECHNICAL FIELD

This invention relates to a valve opening and closing timing control apparatus, specifically, to an improvement of a valve opening and closing timing control apparatus including a drive-side rotational member which rotates synchronously with a crankshaft of an internal combustion engine and a driven-side rotational member which is fixed to a camshaft by a connection bolt that is coaxial with the camshaft, and a spool for fluid control housed at an inner portion of the connection bolt.

BACKGROUND ART

As a valve opening and closing timing control apparatus configured in the aforementioned manner, Patent document 1 discloses a construction where a drive-side rotational member (i.e., a rotation transmission member in the document) and a driven-side rotational member (i.e., a rotation member in the document) are arranged coaxially with each other, and a spool valve is supported to be movable in an axial direction at an inner portion of a connection bolt (i.e., a mounting bolt in the document) connecting a rotor to a camshaft.

In Patent document 1, an electromagnetic drive mechanism which operates and moves the spool valve is provided at the outside of the driven-side rotational member. Fluid controlled by the operation of the spool valve is supplied to or discharged from an advanced angle chamber and a retarded angle chamber from an outer peripheral surface of the mounting bolt to thereby specify a relative rotational phase of the valve opening and closing timing control apparatus. An opening and closing timing of a valve is specified accordingly.

Patent document 2 discloses a solenoid valve, which is provided at the outside of the valve opening and closing timing control apparatus, including a spool and a sleeve that accommodates the spool to be movable. In the solenoid valve, a first port at which fluid is supplied to the sleeve, and a second port and a third port in communication with the valve opening and closing timing control apparatus are provided. An outer peripheral surface of the sleeve is formed to include a substantially letter D cross-sectional shape for obtaining a communication passage via which the first port, the second port and the third port are in communication with one another.

In Patent document 2, the fluid from the first port is supplied to the second port and the third port to ensure a holding operation for holding the valve opening and closing timing control apparatus at an intermediate phase.

DOCUMENT OF PRIOR ART

Patent Document

Patent document 1: JP4013364B2
Patent document 2: JP4032284B2

OVERVIEW OF INVENTION

Problem to be Solved by Invention

In the construction where the spool is housed at the inner portion as disclosed in Patent document 1, supply and discharge of fluid relative to the advanced angle chamber and the retarded angle chamber are controllable from the inner portion of the valve opening and closing timing control apparatus. Thus, the number of components for controlling the fluid is reduced to downsize the valve opening and closing timing control apparatus.

The valve opening and closing timing control apparatus is configured to specify a relative rotational phase by selectively supplying the fluid to the advanced angle chamber and the retarded angle chamber by a control valve. In the valve opening and closing timing control apparatus, however, for example, the fluid slightly leaks from the advanced angle chamber and the retarded angle chamber during a phase control. Therefore, even when a situation where the spool is disposed at a neutral position is continued, the fluid at the advanced angle chamber and the retarded angle chamber leaks to deteriorate a phase holding stability because of an effect of a centrifugal force, for example, caused by a rotation of the valve opening and closing timing control apparatus. The relative rotational phase may be thus greatly fluctuate (so-called flapping) by a cam fluctuation torque applied from the camshaft.

On the other hand, in a state where each of the advanced angle chamber and the retarded angle chamber is filled with the fluid, the relative rotational phase of the valve opening and closing timing control apparatus is likely to be maintained even in a situation where the cam fluctuation torque is applied. As a result, the opening and closing timing of the valve is inhibited from greatly fluctuating.

Engine oil is utilized as hydraulic oil of the valve opening and closing timing control apparatus. Specifically, a leakage of hydraulic oil from the advanced angle chamber and the retarded angle chamber increases in a case where a viscosity of hydraulic oil decreases with an increase of an engine temperature, which leads to a phase holding instability.

In the light of the aforementioned drawback, in the construction of Patent document 2, the supply of fluid (hydraulic oil) is available to the advanced angle chamber and the retarded angle chamber regardless of a set position of the spool so as to restrain flapping, for example.

Nevertheless, in a case where the communication passage is provided at the outer periphery of the sleeve as disclosed in Patent document 2, a flow amount of fluid increases by a decrease of viscosity of the fluid with an increase of a temperature thereof. The flow amount of fluid further increases by an increase of a cross-sectional area of the communication passage because of expansions of the spool and a member accommodating the spool. As a result, the fluid flows unnecessarily, which leads to an inconvenience.

An object of the present invention is to reasonably construct a valve opening and closing timing control apparatus which may restrain a fluctuation of a relative rotational phase even in a case where a leakage amount of fluid from an advanced angle chamber and a retarded angle chamber increases with an increase of a temperature.

Means for Solving Problem

The present invention, according to an aspect thereof, includes a drive-side rotational member rotating synchronously with a crankshaft of an internal combustion engine, a driven-side rotational member fixed to a camshaft for opening and closing a valve to integrally rotate with the camshaft, an advanced angle chamber and a retarded angle chamber defined by the drive-side rotational member and the driven-side rotational member, a mounting member including a tubular wall portion and being coaxial with the camshaft, the mounting member mounting the driven-side rotational member to the camshaft, and a spool housed within a void which is defined by the tubular wall portion of the mounting member in a reciprocatable manner along an axis of the mounting member, the spool being supplied with fluid discharged from an outside pump. A first port and a second port are provided at the tubular wall portion of the mounting member, the first port and the second port allowing fluid to selectively flow to the advanced angle chamber and the retarded angle chamber or flow out from the advanced angle chamber and the retarded angle chamber based on a movement of the spool. A first flow passage connecting the first port and the advanced angle chamber to each other and a second flow passage connecting the second port and the retarded angle chamber to each other are provided at the driven-side rotational member. A thermal expansion coefficient of a material forming the driven-side rotational member is greater than a thermal expansion coefficient of a material forming the mounting member.

According to the aforementioned construction, a clearance is formed between the mounting member and the driven-side rotational member with an increase of a temperature. Thus, a supply of the fluid to the clearance may achieve a supply of the fluid to the advanced angle chamber from the first flow passage and a supply of the fluid to the retarded angle chamber from the second flow passage. In addition, in a case where a leakage amount of the fluid from the advanced angle chamber and the retarded angle chamber increases due to a decrease of viscosity of the fluid with the increase of the temperature, a supply amount of the fluid to the advanced angle chamber and the retarded angle chamber may increase. Accordingly, a relative rotational phase may be maintained against an effect of a cam fluctuation torque. Even in a case where the leakage amount of the fluid from the advanced angle chamber and the retarded angle chamber increases with the increase of the temperature, the valve opening and closing timing control apparatus which may restrain a fluctuation of the relative rotational phase by the supply of the fluid to the advanced angle chamber and the retarded angle chamber is constructed.

In the present invention, it is favorable that a supply port at which fluid from the pump is supplied to the spool is provided at the tubular wall portion of the mounting member, that a supply flow passage in communication with the supply port is provided at the driven-side rotational member and that at least one of a first communication passage connecting the supply flow passage and the first flow passage to each other and a second communication passage connecting the supply flow passage and the second flow passage to each other is provided at an outer portion of the mounting member.

Accordingly, a portion of the fluid supplied to the supply port may be supplied to at least one of the advanced angle chamber and the retarded angle chamber via the communication passage even in a case where the valve opening and closing timing control apparatus is at a low temperature. In addition, even in a case where the leakage amount of the fluid from the advanced angle chamber and the retarded angle chamber increases due to the decrease of viscosity of the fluid with the increase of the temperature, a passage area of the communication passage is enlarged by a difference in thermal expansion coefficients between a material forming the mounting member and a material forming the driven-side rotational member. Accordingly, an increase of the amount of fluid supplied to at least one of the advanced angle chamber and the retarded angle chamber via the communication passage is available. Specifically, according to the aforementioned construction, because the supplied amount of the fluid increases, the fluid is inhibited from being excessively supplied and from being unnecessarily supplied.

In the present invention, it is favorable that at least one of the first communication passage and the second communication passage is provided at an inner peripheral surface of the driven-side rotational member.

Accordingly, because the communication passage is provided at the inner peripheral surface of the driven-side rotational member, the fluid may be positively supplied to the advanced angle chamber or the retarded angle chamber from the supply port. For example, even at a low temperature at which a temperature of the driven-side rotational member or the mounting member does not reach a high temperature so that a difference in thermal expansions of the aforementioned members is not usable, the fluid may be securely supplied to the advanced angle chamber and the retarded angle chamber, thereby increasing accuracy of a phase control.

In the present invention, it is favorable that at least one of the first communication passage and the second communication passage extends along a rotation axis of the driven-side rotational member, the driven-side rotational member being formed by an extrusion processing of metal.

Accordingly, because the communication passage is manufactured by the extrusion processing, it is not necessary to separately perform a cutting work, for example, for forming the communication passage. The driven-side rotational member may be formed of an aluminum material, for example, including a large thermal expansion coefficient. Thus, the driven-side rotational member is effectively obtainable by the present construction.

The present invention, according to an aspect thereof, includes a drive-side rotational member rotating synchronously with a crankshaft of an internal combustion engine, a driven-side rotational member fixed to a camshaft for opening and closing a valve to integrally rotate with the camshaft, an advanced angle chamber and a retarded angle chamber defined by the drive-side rotational member and the driven-side rotational member, a mounting member including a tubular wall portion and being coaxial with the camshaft, the mounting member mounting the driven-side rotational member to the camshaft, and a spool housed within a void which is defined by the tubular wall portion of the mounting member in a reciprocatable manner along an axis of the mounting member, the spool being supplied with fluid discharged from an outside pump. A first port and a second port are provided at the tubular wall portion of the mounting member, the first port and the second port allowing fluid to selectively flow to the advanced angle chamber and the retarded angle chamber or flow out from the advanced angle chamber and the retarded angle chamber based on a movement of the spool. A first flow passage connecting the first port and the advanced angle chamber to each other and a second flow passage connecting the second port and the retarded angle chamber to each other are provided at the driven-side rotational member. A partition member is provided between the driven-side rotational member and the mounting member, the partition member being formed of a material including a greater thermal expansion coefficient than a thermal expansion coefficient of a material forming the mounting member.

According to the aforementioned construction, a clearance is defined between the mounting member and the partition member with the increase of the temperature. Thus, the supply of the fluid to the clearance may achieve the supply of the fluid to the advanced angle chamber from the first flow passage and the supply of the fluid to the retarded angle chamber from the second flow passage. In addition, in a case where the leakage amount of the fluid from the advanced angle chamber and the retarded angle chamber increases due to the decrease of viscosity of the fluid with the increase of the temperature, the supply amount of the fluid to the advanced angle chamber and the retarded angle chamber may increase. Accordingly, the relative rotational phase may be maintained against the effect of the cam fluctuation torque. Even in a case where the leakage amount of the fluid from the advanced angle chamber and the retarded angle chamber increases with the increase of the temperature, the valve opening and closing timing control apparatus which may restrain the fluctuation of the relative rotational phase by the supply of the fluid to the advanced angle chamber and the retarded angle chamber is constructed.

In the present invention, it is favorable that a supply port at which fluid from the pump is supplied to the spool is provided at the tubular wall portion of the mounting member, that a supply flow passage in communication with the supply port is provided at the driven-side rotational member and that at least one of a first communication passage connecting the supply flow passage and the first flow passage to each other and a second communication passage connecting the supply flow passage and the second flow passage to each other is provided at an outer portion of the mounting member.

Accordingly, in a case where the temperature of the valve opening and closing timing control apparatus increases, the clearance between an outer periphery of the tubular wall portion of the mounting member and an inner periphery of the partition member increases compared before the increase of the temperature, because of the difference in thermal expansion rates between the mounting member and the partition member. Accordingly, with the increase of the temperature, a portion of the fluid supplied to the supply port may be sent to the first flow passage via the clearance or a portion of the fluid supplied to the supply port may be sent to the second flow passage via the clearance. Even with the leakage of the fluid from the advanced angle chamber and the retarded angle chamber, a sufficient amount of fluid for compensating the leakage amount is supplied to the advanced angle chamber or the retarded angle chamber to thereby maintain the relative rotational phase against the cam fluctuation torque.

In the present invention, it is favorable that at least one of the first communication passage and the second communication passage is provided at an inner peripheral surface of the partition member.

Accordingly, because the communication passage is provided at the inner peripheral surface of the partition member, the fluid may be positively supplied to the advanced angle chamber or the retarded angle chamber from the supply port. For example, even at a low temperature at which a temperature of the driven-side rotational member or the mounting member does not reach a high temperature so that a difference in thermal expansions of the aforementioned members is not usable, the fluid may be securely supplied to the advanced angle chamber and the retarded angle chamber, thereby increasing accuracy of the phase control.

In the present invention, it is favorable that at least one of the first communication passage and the second communication passage is provided at an outer peripheral surface of the mounting member.

Accordingly, because the communication passage is provided at the outer peripheral surface of the mounting member, the fluid may be positively supplied to the advanced angle chamber or the retarded angle chamber from the supply port. For example, even at a low temperature at which a temperature of the driven-side rotational member or a connection bolt does not reach a high temperature so that a difference in thermal expansions of the aforementioned members is not usable, the fluid may be securely supplied to the advanced angle chamber and the retarded angle chamber, thereby increasing accuracy of the phase control.

In the present invention, it is favorable that a flow passage resistance of the first communication passage and a flow passage resistance of the second communication passage at an outer portion of the mounting member are different from each other.

Accordingly, because the passage resistance of the first communication passage and the passage resistance of the first communication passage are different from each other, the flow amount of the fluid flowing to the first communication passage and the flow amount of the fluid flowing to the second communication passage may be differentiated from each other. As a result, a greater amount of fluid is supplied to the advanced angle chamber than to the retarded angle chamber in a case where the relative rotational phase tends to be displaced to the retarded angle direction by the cam fluctuation torque, thereby maintaining the relative rotational phase against the effect of the cam fluctuation torque.

MODE FOR CARRYING OUT THE INVENTION

An embodiment of the present invention is explained below with reference to drawings.

[Basic Construction]

Figure 1:
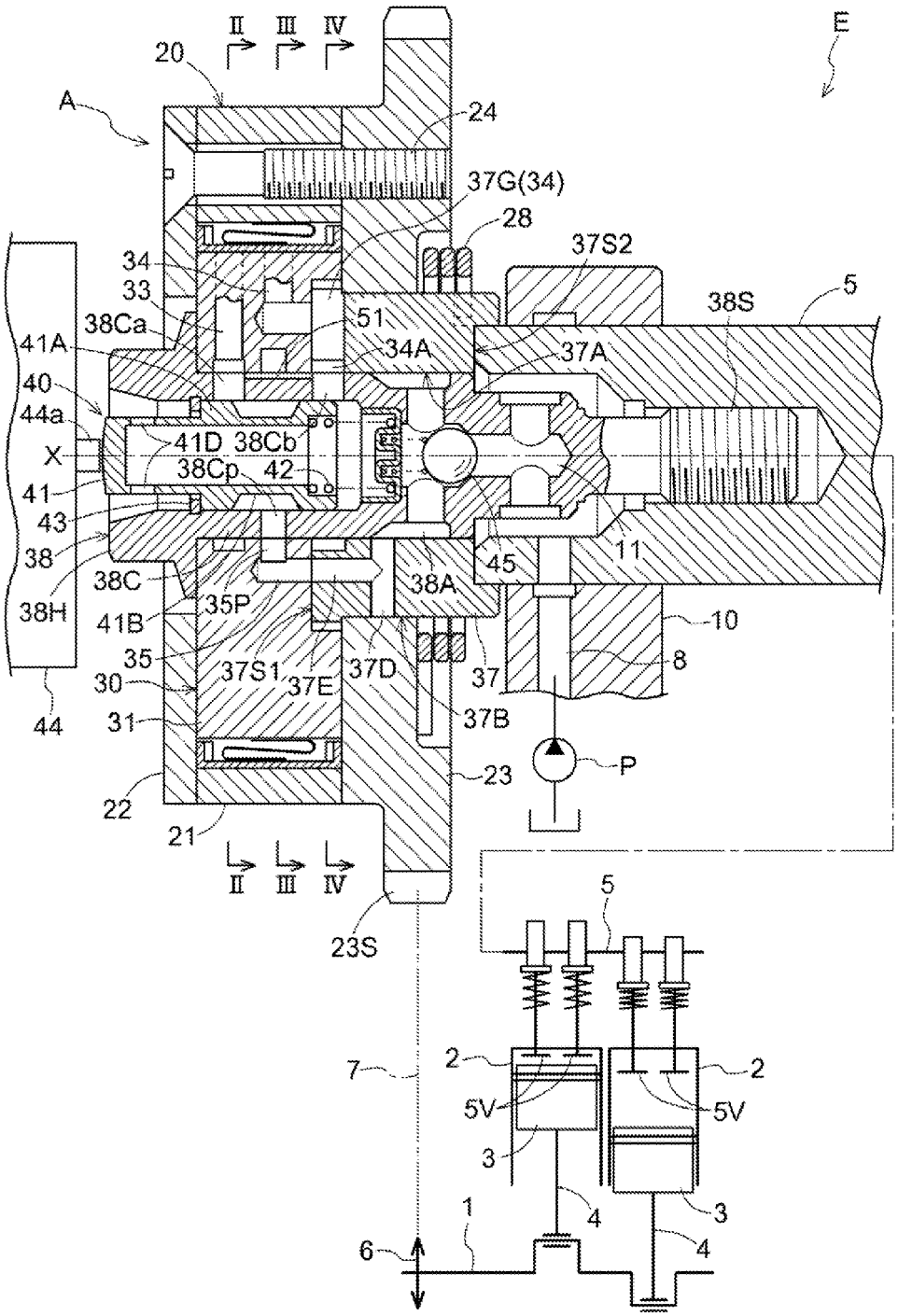
FIG. 1 is a cross-sectional view of a valve opening and closing timing control apparatus.
Figure 2:
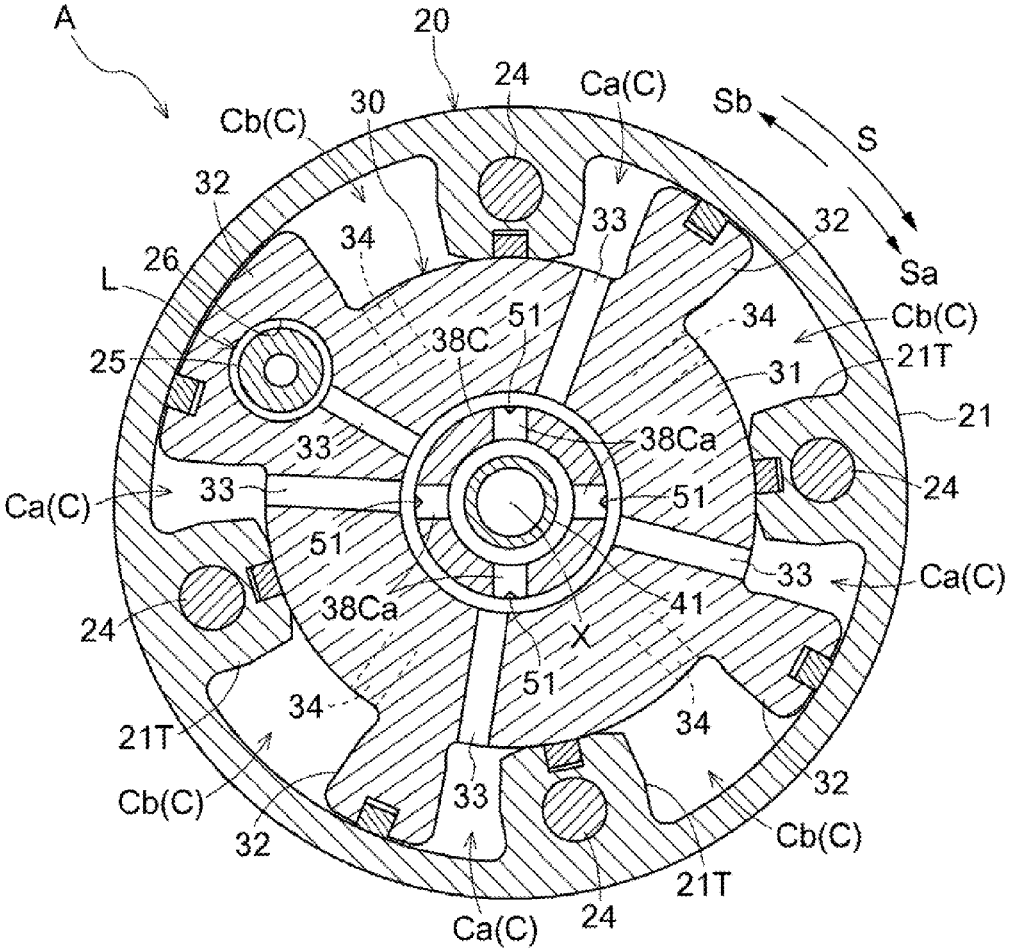
FIG. 2 is a cross-sectional view taken along a line II-II in FIG. 1.

As illustrated in FIGS. 1 and 2, a valve opening and closing timing control apparatus A is constituted by an outer rotor 20 (an example of a drive-side rotational member) rotating synchronously with a crankshaft 1 of an engine E serving as an internal combustion engine and an inner rotor 30 (an example of a driven-side rotational member) integrally rotating in a coaxial manner with an intake camshaft 5 in a combustion chamber of the engine E in a state where the outer rotor 20 and the inner rotor 30 are relatively rotatable about a rotation axis X of the intake camshaft 5.

In the valve opening and closing timing control apparatus A, the inner rotor 30 is disposed within the outer rotor 20 in a state where the inner rotor 30 is connected to the intake camshaft 5 by a connection bolt 38 (an example of a mounting member) penetrating through a center portion of the inner rotor 30. A spool 41 is housed within a void of the connection bolt 38 with the same axis as a bolt axis (which matches the rotation axis X) so that the spool 41 is reciprocatingly operable (reciprocatable) along the bolt axis. A spool spring 42 which biases the spool 41 is also housed within the void of the connection bolt 38. In addition, an electromagnetic solenoid 44 operating the spool 41 is supported at the engine E. The spool 41, the spool spring 42 and the electromagnetic solenoid 44 constitute an electromagnetic control valve 40.

The valve opening and closing timing control apparatus A is configured to change a relative rotational phase between the outer rotor 20 and the inner rotor 30 by a control of hydraulic oil (an example of fluid) by the electromagnetic control valve 40 to thereby control an opening and closing timing of each intake valve 5V. In the aforementioned construction, the spool 41 and the spool spring 42 integrally rotate with the inner rotor 30.

FIG. 1 illustrates the engine E (an example of the internal combustion engine) mounted at a vehicle such as a passenger automobile, for example. In the engine E, a piston 3 is housed within a cylinder bore of a cylinder block 2 at an upper position of the crankshaft 1. The piston 3 and the crankshaft 1 are connected to each other by a connecting rod 4 so that the engine E serves as a four-cycle engine.

The engine E includes, at an upper portion, the intake camshaft 5 for opening and closing the intake valves 5V and an exhaust camshaft. In addition, the engine E includes an oil pressure pump P (an example of a hydraulic pump) driven by the crankshaft 1. The oil pressure pump P supplies lubrication oil stored at an oil pan of the engine E to the electromagnetic control valve 40 as the hydraulic oil (an example of fluid) via a supply flow passage 8.

A timing chain 7 is wound across an output sprocket 6 provided at the crankshaft 1 of the engine E and a timing sprocket 23S of the outer rotor 20. Thus, the outer rotor 20 synchronously rotates with the crankshaft 1. A sprocket, not illustrated, is also provided at a front end of the exhaust-side camshaft. The timing chain 7 is also wound at the aforementioned sprocket.

As illustrated in FIG. 2, in the valve opening and closing timing control apparatus A, the outer rotor 20 rotates in a driving rotation direction S by a driving force from the crankshaft 1. A direction where the inner rotor 30 rotates relative to the outer rotor 20 in the same direction as the driving rotation direction S is referred to as an advanced angle direction Sa and an opposite direction from the advanced angle direction Sa is referred to as a retarded angle direction Sb. In the valve opening and closing timing control apparatus A, a relationship between the crankshaft 1 and the intake camshaft 5 is specified so that an intake compression ratio increases with an increase of a displacement amount upon displacement of the relative rotational phase in the advanced angle direction Sa, and the intake compression ratio decreases with the increase of the displacement amount upon displacement of the relative rotational phase in the retarded angle direction Sb.

In the present embodiment, the valve opening and closing timing control apparatus A is provided at the intake camshaft 5. Alternatively, the valve opening and closing timing control apparatus A may be provided at the exhaust camshaft. Further alternatively, the respective valve opening and closing timing control apparatuses A may be provided at both the intake camshaft 5 and the exhaust camshaft.

[Valve Opening and Closing Timing Control Apparatus]

As illustrated in FIGS. 1 to 5, the valve opening and closing timing control apparatus A includes the outer rotor 20 and the inner rotor 30 and also includes an adapter 37 in a bush form which is sandwiched between the inner rotor 30 and the intake camshaft 5.

The outer rotor 20 includes an outer rotor body 21, a front plate 22 and a rear plate 23, which are integrally provided by fastening of plural fastening bolts 24. The timing sprocket 23S is provided at an outer circumference of the rear plate 23.

Plural protruding portions 21T are integrally provided at the outer rotor body 21 so as to protrude inwardly in a radial direction with reference to the rotation axis X. The inner rotor 30 includes an inner rotor body 31 in a column form which is tightly in contact with protruding ends of the respective protruding portions 21T of the outer rotor body 21 and plural (four) vane portions 32 which protrude at an outer circumference of the inner rotor body 31 so as to make contact with an inner peripheral surface of the outer rotor body 21.

Accordingly, the inner rotor 30 is internally disposed relative to the outer rotor 20 so that plural hydraulic chambers C are defined at an outer circumferential side of the inner rotor body 31. Each of the hydraulic chambers C is disposed at an intermediate position of the adjacent protruding portions 21T in a rotation direction. Each of the hydraulic chambers C is divided by the vane portion 32 to define an advanced angle chamber Ca and a retarded angle chamber Cb.

In the valve opening and closing timing control apparatus A, the outer rotor body 21 and the inner rotor body 31 are made of aluminum alloy. The connection bolt 38 and the adapter 37 are formed of steel including iron. Because of the aforementioned setting of the materials, a thermal expansion coefficient of the inner rotor body 31 is specified to be greater than a thermal expansion coefficient of each of the connection bolt 38 and the adapter 37.

The valve opening and closing timing control apparatus A includes a lock member 25 which is slidably movable at a guide bore 26 provided at one of the plural vane portions 32 in a state where the guide bore 26 is positioned along the rotation axis X and includes a lock spring biasing the lock member 25 to protrude. A lock recess portion is provided at the rear plate 23 so that the lock member 25 is engageable and disengageable relative to the lock recess portion. The lock member 25, the lock spring and the lock recess portion constitute a lock mechanism L.

The lock mechanism L holds the relative rotational phase to a most retarded angle phase in a state where the lock member 25 engages with the lock recess portion by a biasing force of the lock spring.

As illustrated in FIG. 1, a torsion spring 28 is provided across the adapter 37 and the front plate 22 for applying a biasing force to the relative rotational phase between the outer rotor 20 and the inner rotor 30 (hereinafter referred to as the relative rotational phase) from the most retarded angle phase to an intermediate phase which are explained later.

The connection bolt 38 includes a bolt head portion 38H and an externally threaded portion 38S. The externally threaded portion 38S is screwed to an internally threaded portion of the intake camshaft 5 so that the inner rotor 30 is connected to the intake camshaft 5 via the adapter 37. The inner rotor 30, the adapter 37 and the intake camshaft 5 integrally rotate with one another.

A tubular wall portion 38C is provided with reference to the rotation axis X at a portion in the connection bolt 38 closer to the bolt head portion 38H. The spool 41 is housed at an inner portion of the tubular wall portion 38C. Further, an intermediate recess portion 38A is provided at an outer periphery of the connection bolt 38 so as to send out the hydraulic oil.

The adapter 37 is formed in a tubular form including an inner peripheral surface 37A which includes an inner diameter so as to make contact with an outer peripheral surface of an intermediate portion of the connection bolt 38, an outer peripheral surface 37B in contact with an inner periphery of the rear plate 23, a first side wall 37S1 in contact with the inner rotor body 31 and a second side wall 37S2 in contact with the intake camshaft 5.

Figure 5:
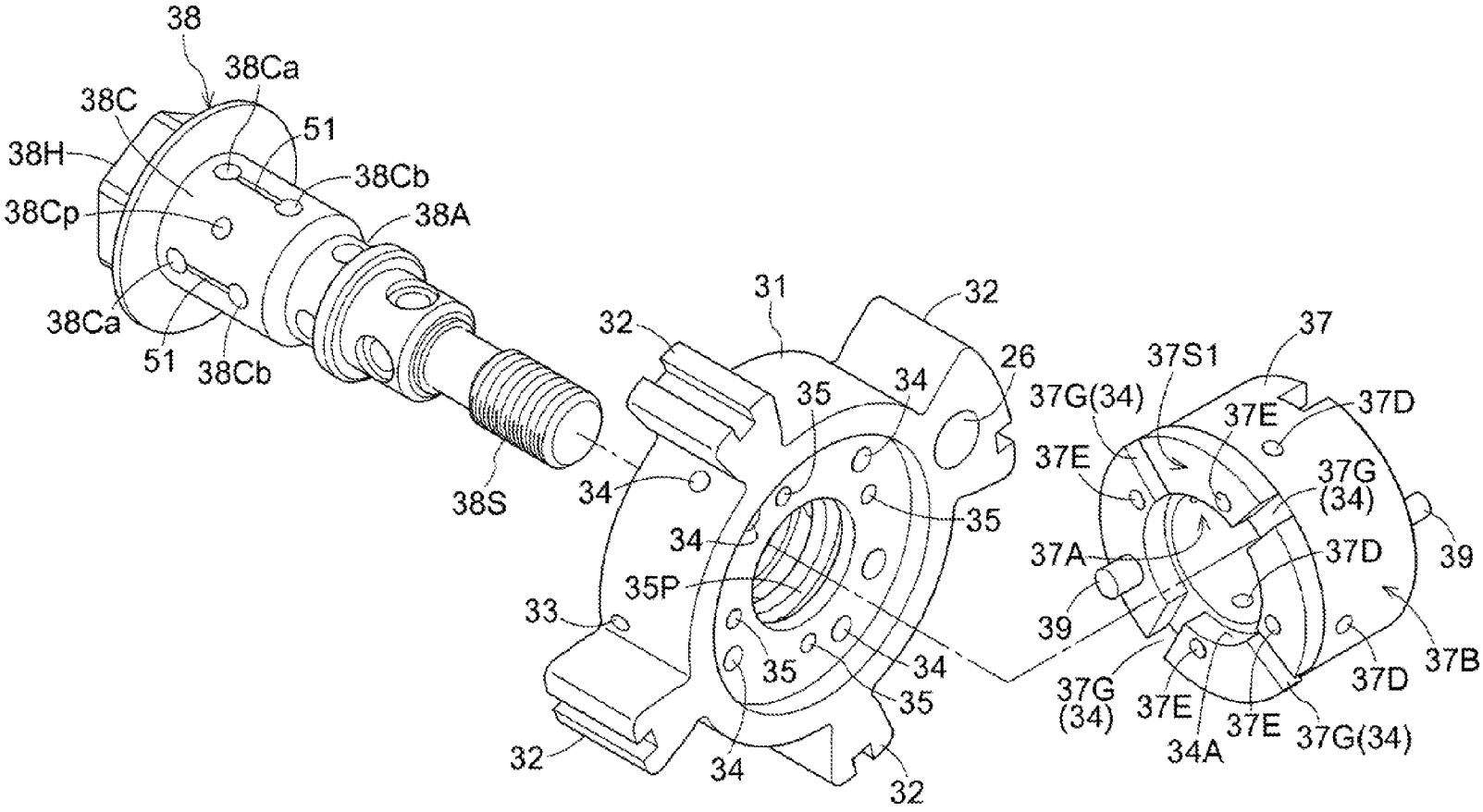
FIG. 5 is a perspective view of a connection bolt, an inner rotor and an adapter.

As illustrated in FIG. 5, restriction pins 39 are fitted to positions at which the restriction pins 39 penetrate through a contact surface between the inner rotor 30 and the adapter 37 and a contact surface between the adapter 37 and the intake camshaft 5 in a state where the restriction pins 39 are positioned in parallel to the rotation axis X. As a result, the inner rotor 30, the adapter 37 and the intake camshaft 5 integrally rotate with one another.

The adapter 37 is provided with plural (four) outlet flow passages 37D each of which is in a radial form for sending the hydraulic oil supplied to the inner peripheral surface 37A from the intermediate recess portion 38A of the connection bolt 38 to the outer peripheral surface 37B. Each of the outlet flow passages 37D is formed in a penetrating manner by drilling. The adapter 37 is provided with plural (four) branching flow passages 37E arranged in parallel to the rotation axis X for sending the hydraulic oil from each of the outlet flow passages 37D towards the first side wall 37S1.

The aforementioned branching flow passages 37E are in communication with respective pump flow passages 35 (each of which is an example of a supply flow passage) provided at the inner rotor body 31. Plural groove portions 37G are radially formed at the first side wall 37S1 in a range from the annular recess portion 37C to the outer peripheral surface 37B. Each of the groove portions 37G constitutes a portion of each retarded angle flow passage 34.

[Valve Opening and Closing Timing Control Apparatus: Construction of Oil Passage]

A void for displacing the relative rotational phase to the advanced angle direction Sa with the supply of the hydraulic oil is the advanced angle chamber Ca. On the other hand, a void for displacing the relative rotational phase to the retarded angle direction Sb with the supply of the hydraulic oil is the retarded angle chamber Cb. The relative rotational phase in a state where the vane portion 32 reaches an operation end in the advanced angle direction Sa (including a phase in the vicinity of the operation end of the vane portion 32 in the advanced angle direction Sa) is referred to as a most advanced angle phase. The relative rotational phase in a state where the vane portion 32 reaches an operation end in the retarded angle direction Sb (including a phase in the vicinity of the operation end of the vane portion 32 in the retarded angle direction Sb) is referred to as the most retarded angle phase.

The pump flow passages 35 (each of which is the example of the supply flow passage) positioned in parallel to the rotation axis X so as to supply the hydraulic oil from the oil pressure pump P to the spool 41, advanced angle flow passages 33 (each of which is an example of a first flow passage) in communication with the respective advanced angle chambers Ca and the retarded angle flow passages 34 (each of which is an example of a second flow passage) in communication with the respective retarded angle chambers Cb are provided at the inner rotor body 31.

The advanced angle flow passage 33 is connected to the lock recess portion. Thus, in a case where the hydraulic oil is supplied to the advanced angle chambers Ca via the advanced angle flow passages 33, the lock member 25 disengages from the lock recess portion against the biasing force of the lock spring, thereby releasing the locked state.

The spool spring 42 applies a biasing force in a direction where the spool 41 is separated from the intake camshaft 5. The connection bolt 38 includes a stopper 43 which decides an operation end of an outer end side of the spool 41.

The electromagnetic solenoid 44 includes a plunger 44*a* which operates to protrude by an amount proportional to an electric power supplied to a solenoid provided at an inside of the electromagnetic solenoid 44. The spool 41 is operated by a pressing force of the plunger 44*a*.

Land portions 41A are provided at an inner end side (i.e., a side where the intake camshaft 5 is provided) and an outer end side. A groove portion 41B in an annular form is provided over an entire circumference at an intermediate position between the aforementioned land portions 41A. An inside of the spool 41 is formed to be hollow. A drain bore 41D is provided at a protruding end of the spool 41.

A pump port 38Cp (an example of a supply port) supplied with the hydraulic oil from the pump flow passage 35 is provided at the tubular wall portion 38C of the connection bolt 38. In addition, advanced angle ports 38Ca (each of which is an example of a first port) for performing supply and discharge of the hydraulic oil relative to the advanced angle chambers Ca by the operation of the spool 41 and retarded angle ports 38Cb (each of which is an example of a second port) for performing supply and discharge of the hydraulic oil relative to the retarded angle chambers Cb by the operation of the spool 41 are provided at the tubular wall portion 38C. The advanced angle ports 38Ca and the retarded angle ports 38Cb are arranged in a manner that the pump port 38Cp is disposed between the advanced angle ports 38Ca and the retarded angle ports 38Cb in a direction along the rotation axis X.

A pump-side annular groove 35P in communication with the pump port 38Cp is provided at an inner periphery of the inner rotor body 31. The plural (four) pump flow passages 35 are in communication with the pump-side annular groove 35P. In addition, an advanced angle side annular groove 33A in communication with the advanced angle ports 38Ca is provided at the inner periphery of the inner rotor body 31. The plural (four) advanced angle flow passages 33 are in communication with the advanced angle side annular groove 33A. Further, a retarded angle side annular groove 34A in communication with the retarded angle ports 38Cb is provided at an inner periphery of the adapter 37. The plural (four) retarded angle flow passages 34 are in communication with the retarded angle side annular groove 34A.

Figure 3:
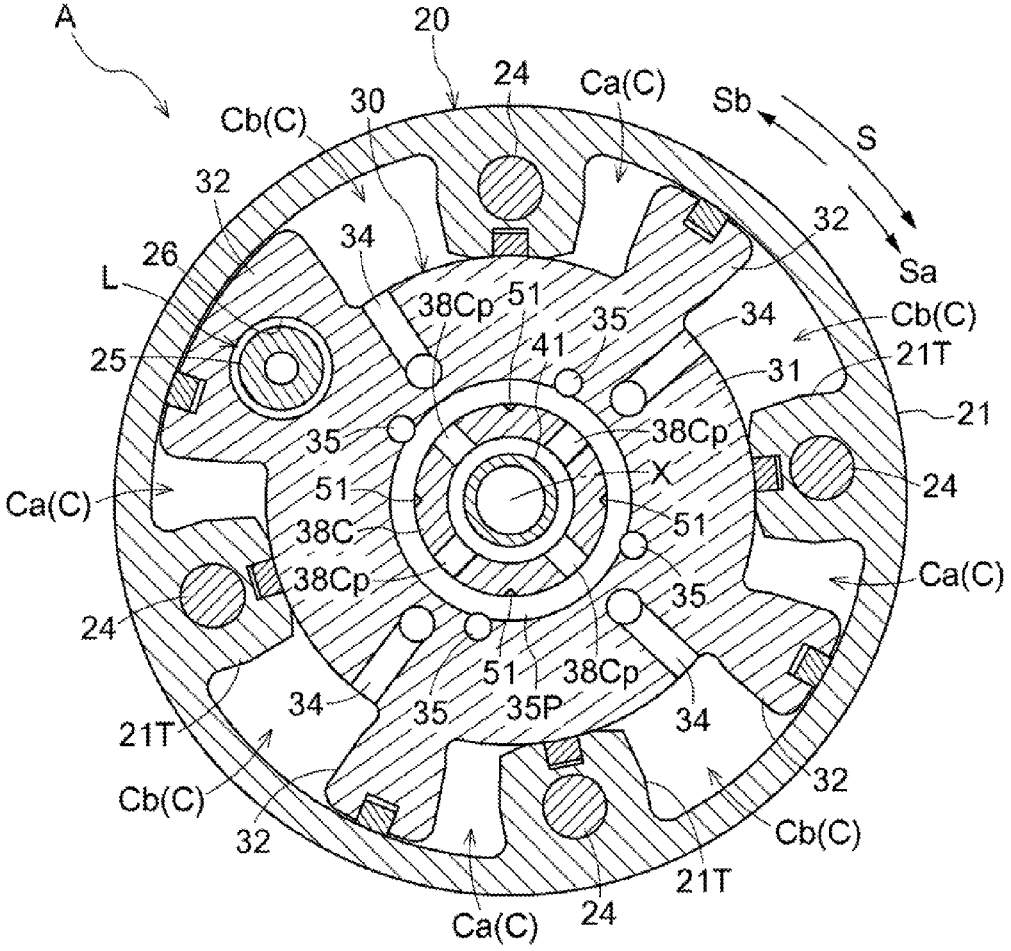
FIG. 3 is a cross-sectional view taken along a line III-Ill in FIG. 1.
Figure 4:
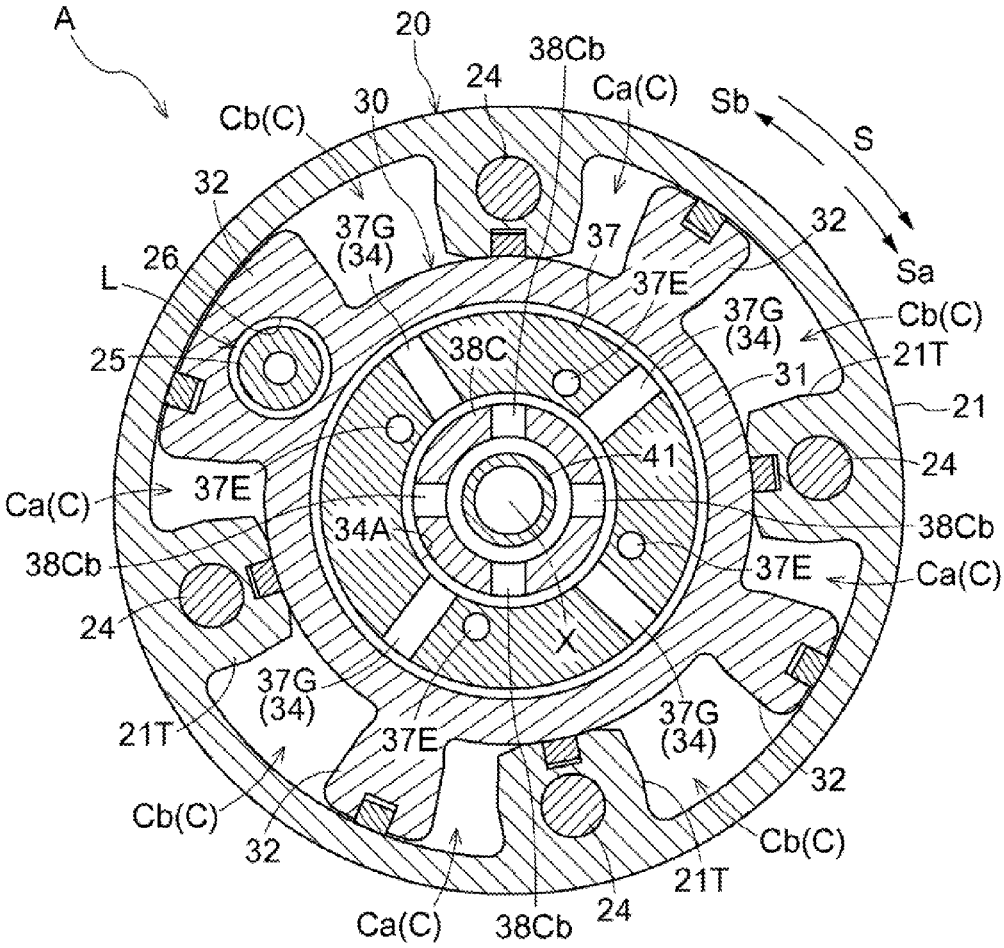
FIG. 4 is a cross-sectional view taken along a line IV-IV in FIG. 1.

Specifically, as illustrated in FIGS. 1, 3 and 4, the retarded angle flow passages 34 are constituted by the retarded angle side annular groove 34A provided at the inner periphery of the adapter 37, the groove portions 37G provided at the first side wall 37S1 of the adapter 37 and a bore portion bored at the inner rotor body 31.

The electromagnetic solenoid 44 is retained at a non-pressing position as illustrated in FIG. 1 in a non-power supply state. In the non-pressing position, the spool 41 is retained at an advanced angle position as illustrated in FIG. 1. In a state where a predetermined electric power is supplied to the electromagnetic solenoid 44, the plunger 44*a* reaches a pressing position at an inner end side so that the spool 41 is retained at a retarded angle position. Further, in a state where a lower electric power than the predetermined electric power is supplied to the electromagnetic solenoid 44, the spool 41 is retained at a neutral position (a position illustrated in FIG. 6) at which the protruding amount of the plunger 44*a* is restricted so that the spool 41 is retained at an intermediate position between the retarded angle position and the advanced angle position.

The supply flow passage 8 supplying the hydraulic oil from the oil pressure pump P is provided at an engine constituting member 10 which supports the intake camshaft 5 to be rotatable.

A supply void 11 is defined at the inside of the connection bolt 38 for supplying the hydraulic oil from the supply flow passage 8. A check valve 45 constituted by a spring and a ball is provided at the inside of the supply void 11. The intermediate recess portion 38A to which the hydraulic oil that passes through the check valve 45 is supplied is annularly provided at the outer circumference of the connection bolt 38 over an entire circumference thereof.

Accordingly, the hydraulic oil from the oil pressure pump P is supplied to the supply void 11 through the supply flow passage 8 and further to the intermediate recess portion 38A through the check valve 45. The hydraulic oil supplied to the intermediate recess portion 38A is sent to the plural outlet flow passages 37D from the inner peripheral surface 37A of the adapter 37 and is supplied to the groove portion 41B of the spool 41 sequentially through the branching flow passages 37E in communication with the outlet flow passages 37D, the pump flow passages 35 and the pump port 38Cp.

When the spool 41 is specified at the advanced angle position (position illustrated in FIG. 1) under circumstances where the hydraulic oil is supplied to the spool 41, the hydraulic oil from the pump port 38Cp is sent to the advanced angle ports 38Ca while the hydraulic oil is discharged from the retarded angle ports 38Cb. On the other hand, in a case where the spool 41 is specified at the retarded angle position, the hydraulic oil from the pump port 38Cp is sent to the retarded angle ports 38Cb while the hydraulic oil from the advanced angle ports 38Ca is discharged. In a case where the spool 41 is specified at the neutral position, the supply and discharge of the hydraulic oil relative to the advanced angle ports 38Ca and the retarded angle ports 38Cb are interrupted.

Accordingly, in a case where the spool 41 is specified at the advanced angle position, the retarded angle position, or the neutral position, the relative rotational phase is displaced to the advanced angle direction Sa, displaced to the retarded angle direction Sb or retained.

[Communication Passage: Outer Circumferential Side Communication Passage]

Figure 6:
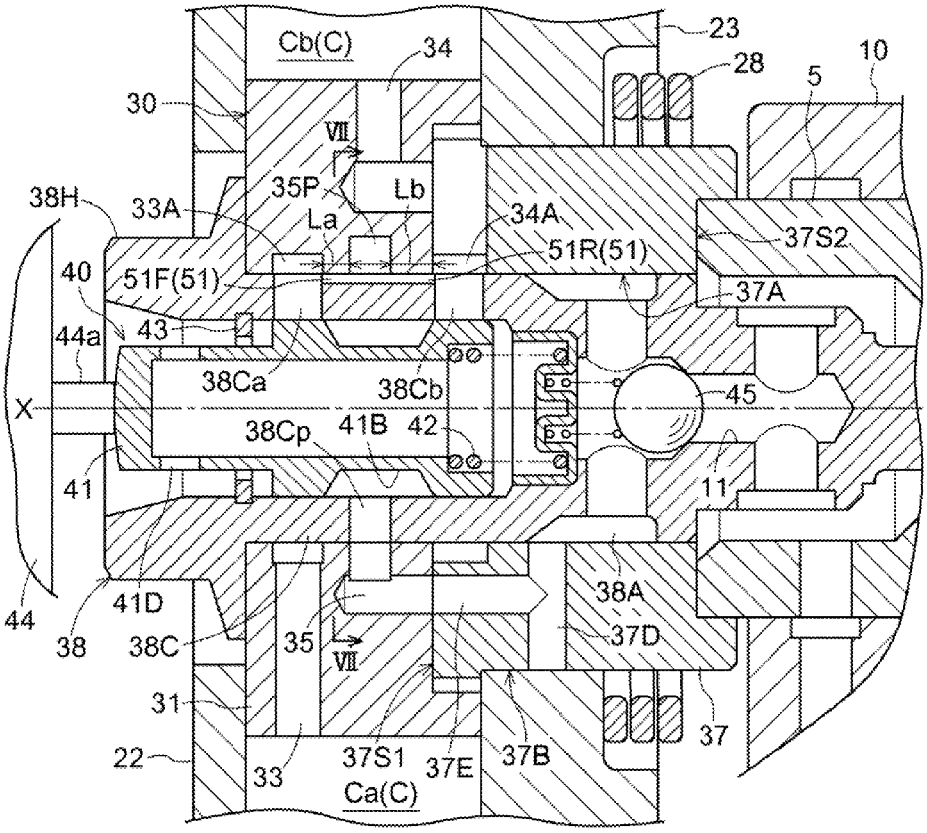
FIG. 6 is a cross-sectional view illustrating an outer circumferential side communication passage.
Figure 7:
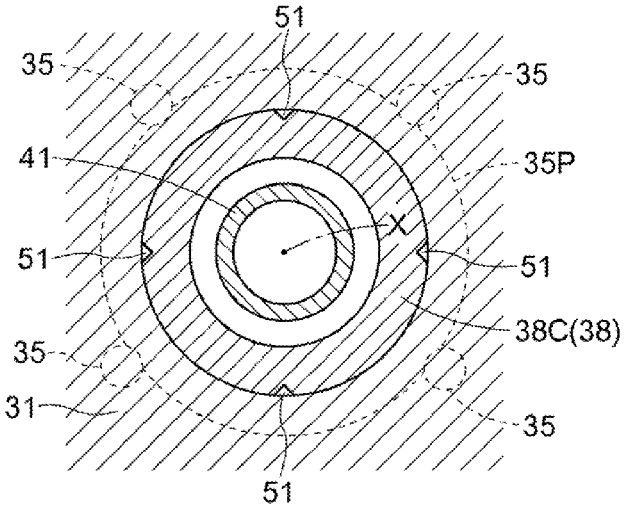
FIG. 7 is a cross-sectional view taken along a line VII-VII in FIG. 6.

The valve opening and closing timing control apparatus A of the embodiment is constructed so that the hydraulic oil leaks from the advanced angle chambers Ca and the retarded angle chambers Cb even in a state where the spool 41 is at the neutral position. Thus, as illustrated in FIGS. 6 and 7, plural (four) outer circumferential side communication passages 51 are provided at the outer periphery of the connection bolt 38 so as to compensate the leakage of the hydraulic oil by supplying the hydraulic oil to the advanced angle chambers Ca and the retarded angle chambers Cb. The outer circumferential side communication passages 51 are also configured to increase an amount of supply oil with a decrease of viscosity of the hydraulic oil in a case where an oil temperature increases.

Each of the outer circumferential side communication passages 51 is constituted by an outer circumferential side advanced angle communication passage 51F (an example of a first communication passage) and an outer circumferential side retarded angle communication passage 51R (an example of a second communication passage) each of which is obtained by cutting the outer periphery of the connection bolt 38 in a groove form. The outer circumferential side advanced angle communication passage 51F is provided at a position for connecting between the pump flow passage 35 (specifically, the pump-side annular groove 35P) and the advanced angle flow passage 33 (specifically, the advanced angle side annular groove 33A) to supply the hydraulic oil to the advanced angle chamber Ca. In addition, the outer circumferential side retarded angle communication passage 51R is provided at a position for connecting between the pump flow passage 35 (specifically, the pump-side annular groove 35P) and the retarded angle flow passage 34 (specifically, the retarded angle side annular groove 34A) to supply the hydraulic oil to the retarded angle chamber Cb.

Figure 8:
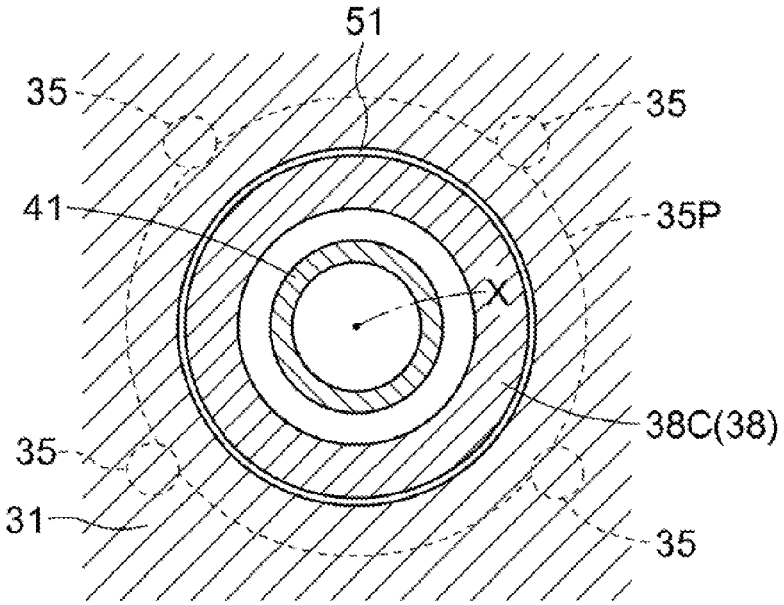
FIG. 8 is a cross-sectional view illustrating an embodiment including a different outer circumferential side communication passage.
Figure 9:
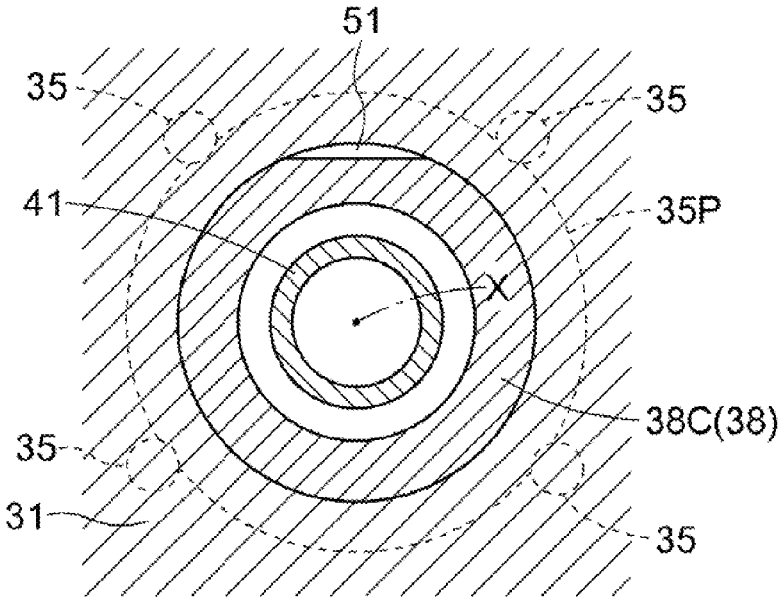
FIG. 9 is a cross-sectional view illustrating an embodiment including a different outer circumferential side communication passage.

Each of the outer circumferential side communication passages 51 of the embodiment is formed in a groove at the outer periphery of the connection bolt 38. Alternatively, as illustrated in FIG. 8, the outer circumferential side communication passage 51 may be formed by cutting the outer periphery of the connection bolt 38 over an entire circumference thereof. Further alternatively, as illustrated in FIG. 9, the outer circumferential side communication passage 51 may be formed by cutting a portion of the outer periphery of the connection bolt 38 in a D form.

Further, the outer circumferential side communication passage 51 may be formed in a rough surface at the outer periphery of the connection bolt 38 so as to serve as a void where the flow of fluid is available.

An advanced angle side communication distance La by which the hydraulic oil flows to the outer circumferential side advanced angle communication passage 51F and a retarded angle side communication distance Lb by which the hydraulic oil flows to the outer circumferential side retarded angle communication passages 51R are specified to be different values from each other. Specifically, the advanced angle side communication distance La is specified to be smaller than the retarded angle side communication distance Lb ($La<Lb$) so that a passage resistance obtained when the hydraulic oil flows through the outer circumferential side advanced angle communication passage 51F is smaller than a passage resistance obtained when the hydraulic oil flows through the outer circumferential side retarded angle communication passage 51R. Accordingly, the amount of oil flowing through the advanced angle flow passage 33 is made greater than the amount of oil flowing through the retarded angle flow passage 34 to obtain a force against a cam fluctuation torque.

The depth of the groove of the outer circumferential side advanced angle communication passage 51F provided at the outer periphery of the connection bolt 38 and the depth of the groove of the outer circumferential side retarded angle communication passage 51R provided at the outer periphery of the connection bolt 38 may be differentiated from each other. As a result, the passage resistance of the outer circumferential side advanced angle communication passage 51F is also smaller than the passage resistance of the outer circumferential side retarded angle communication passages 51R so that the amount of oil flowing through the advanced angle flow passage 33 is made greater than the amount of oil flowing through the retarded angle flow passage 34.

In each of the outer circumferential side communication passages 51, in a case where each of the outer circumferential side advanced angle communication passage 51F and the outer circumferential side retarded angle communication passage 51R is formed in a groove or is cut in a D form, the outer circumferential side advanced angle communication passage 51F and the outer circumferential side retarded angle communication passages 51R are not necessarily arranged on the same line in parallel to the rotation axis X. The outer circumferential side advanced angle communication passage 51F and the outer circumferential side retarded angle communication passages 51R may be arranged on different lines from each other. Either the outer circumferential side advanced angle communication passage 51F or the outer circumferential side retarded angle communication passage 51R may be provided.

[Communication Passage: Inner Circumferential Side Communication Passage]

Figure 10:
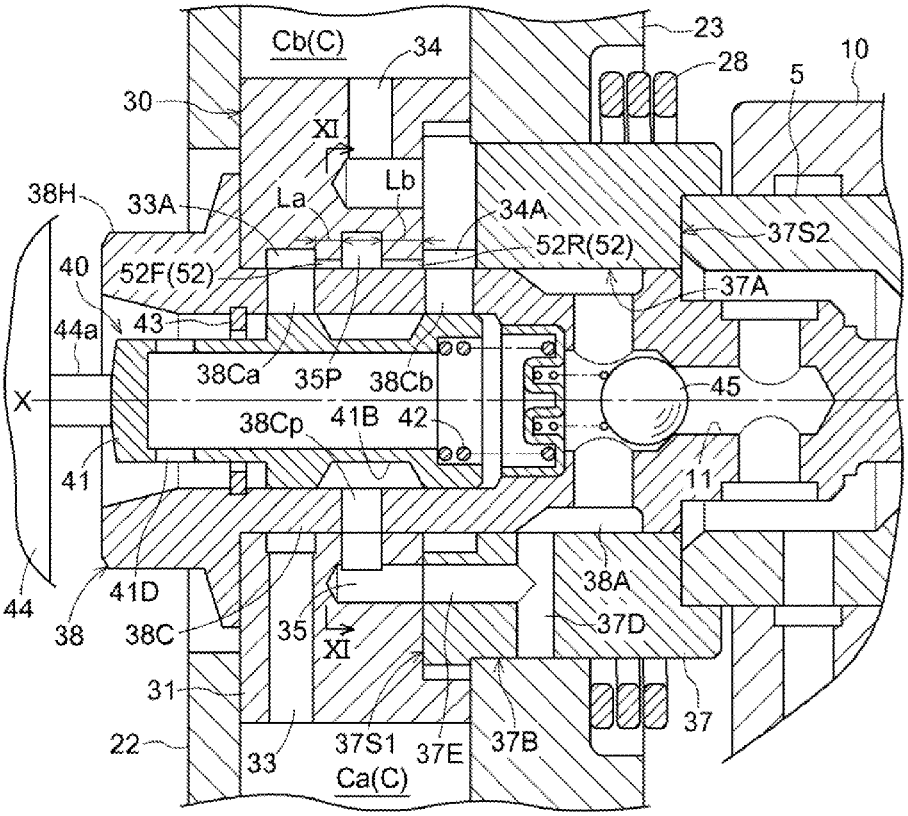
FIG. 10 is a cross-sectional view illustrating an inner circumferential side communication passage.
Figure 11:
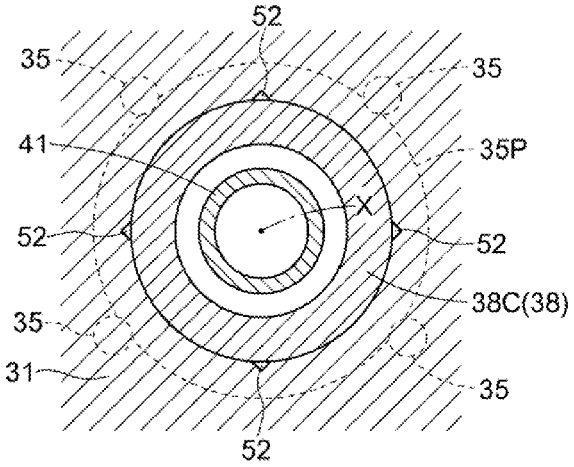
FIG. 11 is a cross-sectional view taken along a line XI-XI in FIG. 10.

In this embodiment, as illustrated in FIGS. 10 and 11, plural (four) inner circumferential side communication passages 52 are provided at the inner periphery of the inner rotor body 31 so as to compensate the leakage of the hydraulic oil by supplying the hydraulic oil to the advanced angle chambers Ca and the retarded angle chambers Cb. The inner circumferential side communication passages 52 are also configured to increase the amount of supply oil with the decrease of viscosity of the hydraulic oil in a case where the oil temperature increases.

Each of the inner circumferential side communication passages 52 is constituted by an inner circumferential side advanced angle communication passage 52F (an example of the first communication passage) and an inner circumferential side retarded angle communication passage 52R (an example of the second communication passage) each of which is obtained by cutting the inner surface of the inner rotor body 31 in a groove form. The inner circumferential side advanced angle communication passage 52F is provided at a position for connecting between the pump flow passage 35 and the advanced angle flow passage 33 to supply the hydraulic oil to the advanced angle chamber Ca. In addition, the inner circumferential side retarded angle communication passage 52R is provided at a position for connecting between the pump flow passage 35 and the retarded angle flow passage 34 to supply the hydraulic oil to the retarded angle chamber Cb.

Figure 12:
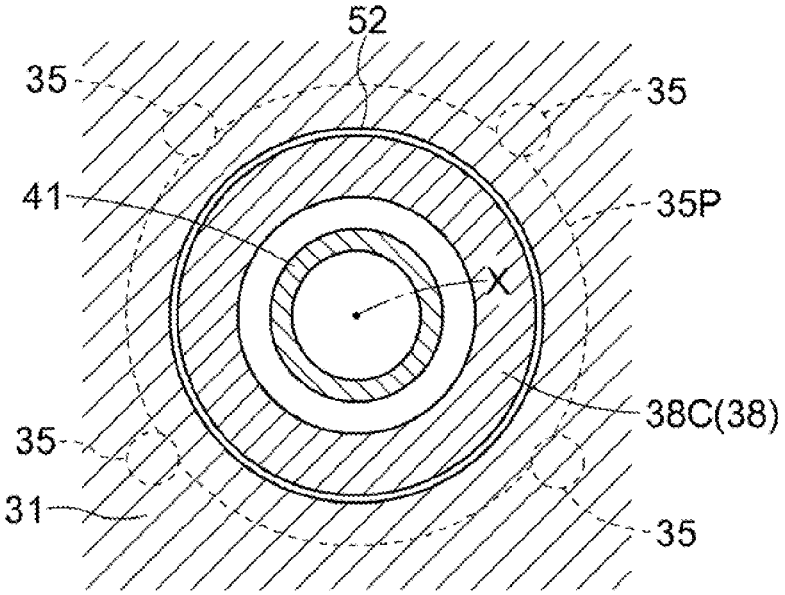
FIG. 12 is a cross-sectional view illustrating an embodiment including a different inner circumferential side communication passage.
Figure 13:
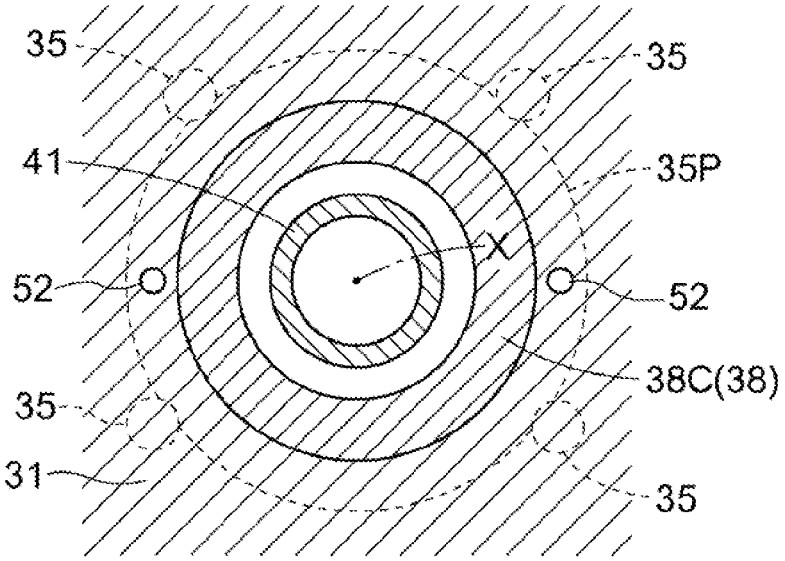
FIG. 13 is a cross-sectional view illustrating an embodiment including a different inner circumferential side communication passage.

Each of the inner circumferential side communication passages 52 of the embodiment is formed in a groove at the inner periphery of the inner rotor body 31. Alternatively, as illustrated in FIG. 12, the inner circumferential side communication passage 52 may be provided by cutting the inner periphery of the inner rotor body 31 over an entire circumference thereof. Further alternatively, as illustrated in FIG. 13, the inner circumferential side communication passage 52 may be provided by a bore portion provided at the inner rotor body 31 in a direction along the rotation axis X. In a case where the inner circumferential side communication passage 52 is obtained by the bore portion, a bored position of the bore portion is specified so that the inner circumferential side communication passage 52 is in communication with the advanced angle side annular groove 33A, the pump flow passage 35 and the retarded angle side annular groove 34A.

Further, the inner circumferential side communication passage 52 may be formed in a rough surface at the inner periphery of the inner rotor body 31 so as to serve as a void where the flow of fluid is available.

The advanced angle side communication distance La by which the hydraulic oil flows to the inner circumferential side advanced angle communication passage 52F and the retarded angle side communication distance Lb by which the hydraulic oil flows to the inner circumferential side retarded angle communication passages 52R are specified to be different values from each other. Specifically, the advanced angle side communication distance La is specified to be smaller than the retarded angle side communication distance Lb ($La<Lb$) so that a passage resistance obtained when the hydraulic oil flows through the inner circumferential side advanced angle communication passage 52F is smaller than a passage resistance obtained when the hydraulic oil flows through the inner circumferential side retarded angle communication passages 52R.

The depth of the groove of the inner circumferential side advanced angle communication passage 52F and the depth of the groove of the inner circumferential side retarded angle communication passage 52R may be differentiated from each other by cutting the inner periphery of the inner rotor body 31. As a result, the passage resistance of the inner circumferential side advanced angle communication passage 51F2 is also smaller than the passage resistance of the inner circumferential side retarded angle communication passages 52R so that the amount of oil flowing through the advanced angle flow passage 33 is made greater than the amount of oil flowing through the retarded angle flow passage 34.

In each of the inner circumferential side communication passages 52, in a case where each of the inner circumferential side advanced angle communication passage 52F and the inner circumferential side retarded angle communication passage 52R is formed in a groove, the inner circumferential side advanced angle communication passage 52F and the inner circumferential side retarded angle communication passage 52R are arranged on the same axis in parallel to the rotation axis X. Alternatively, the inner circumferential side advanced angle communication passage 52F and the inner circumferential side retarded angle communication passage 52R may be arranged on different lines from each other. Further alternatively, either the inner circumferential side advanced angle communication passage 52F or the inner circumferential side retarded angle communication passage 52R may be provided.

Because the inner rotor body 31 is formed by an extrusion processing, the groove portions may be formed on a basis of a setting of a configuration of a die utilized for the extrusion processing.

[Communication Passage: Clearance Communication Passage]

Figure 14:
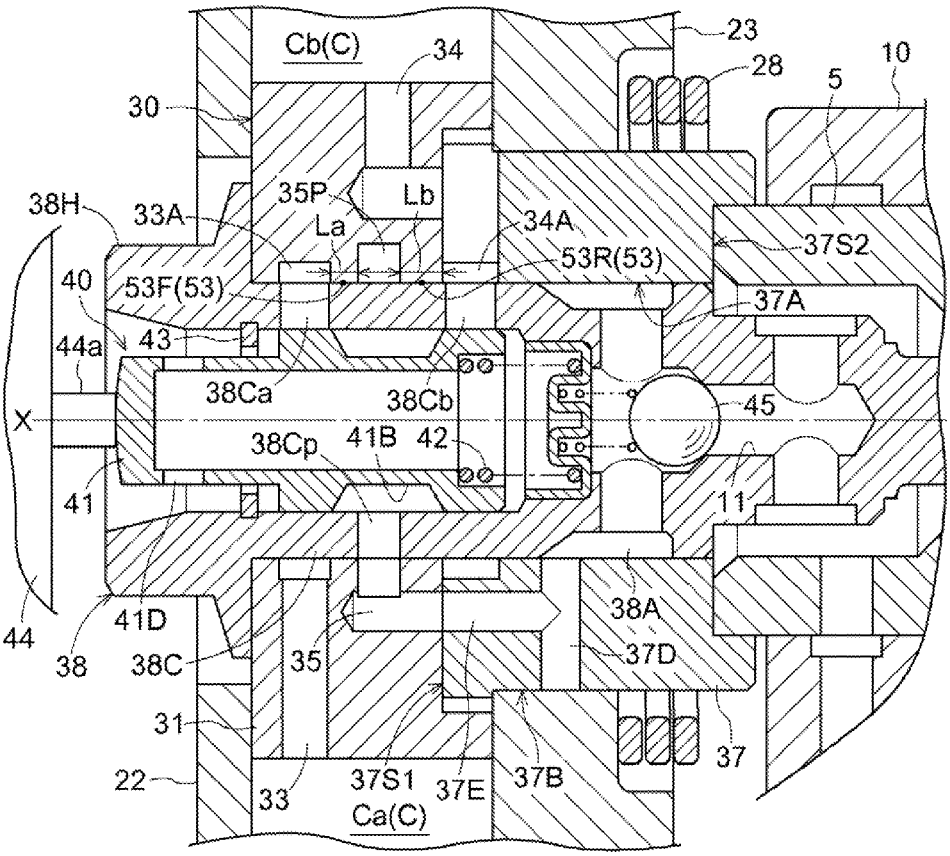
FIG. 14 is a cross-sectional view illustrating a clearance communication passage.

In this embodiment, as illustrated in FIG. 14, a clearance communication passage 53 is obtained by a clearance generated between the inner rotor body 31 and the connection bolt 38 in a case where the temperature increases, on a basis of a difference in thermal expansion rates between the inner rotor body 31 and the connection bolt 38. The clearance communication passage 53 also functions as increasing the supplied oil amount with the decrease of viscosity of the hydraulic oil upon increase of the oil temperature.

The clearance communication passage 53 is constituted by a clearance advanced angle communication passage 53F (an example of the first communication passage) and a clearance retarded angle communication passage 53R (an example of the second communication passage). The clearance advanced angle communication passage 53F is provided at a position for connecting between the pump flow passage 35 and the advanced angle flow passage 33 to supply the hydraulic oil to the advanced angle chamber Ca. The clearance retarded angle communication passage 53R is provided at a position for connecting between the pump flow passage 35 and the retarded angle flow passage 34 to supply the hydraulic oil to the retarded angle chamber Cb.

The advanced angle side communication distance La by which the hydraulic oil flows to the clearance advanced angle communication passage 53F and the retarded angle side communication distance Lb by which the hydraulic oil flows to the clearance retarded angle communication passage 53R are specified to be different values from each other. Specifically, a passage resistance obtained when the hydraulic oil flows to the clearance advanced angle communication passage 53F is smaller than a passage resistance obtained when the hydraulic oil flows to the clearance retarded angle communication passage 53R. As a result, the amount of hydraulic oil flowing to the advanced angle flow passage 33 is made greater than the amount of hydraulic oil flowing to the retarded angle flow passage 34.

[Communication Passage: Modified Example of Clearance Communication Passage]

Figure 15:
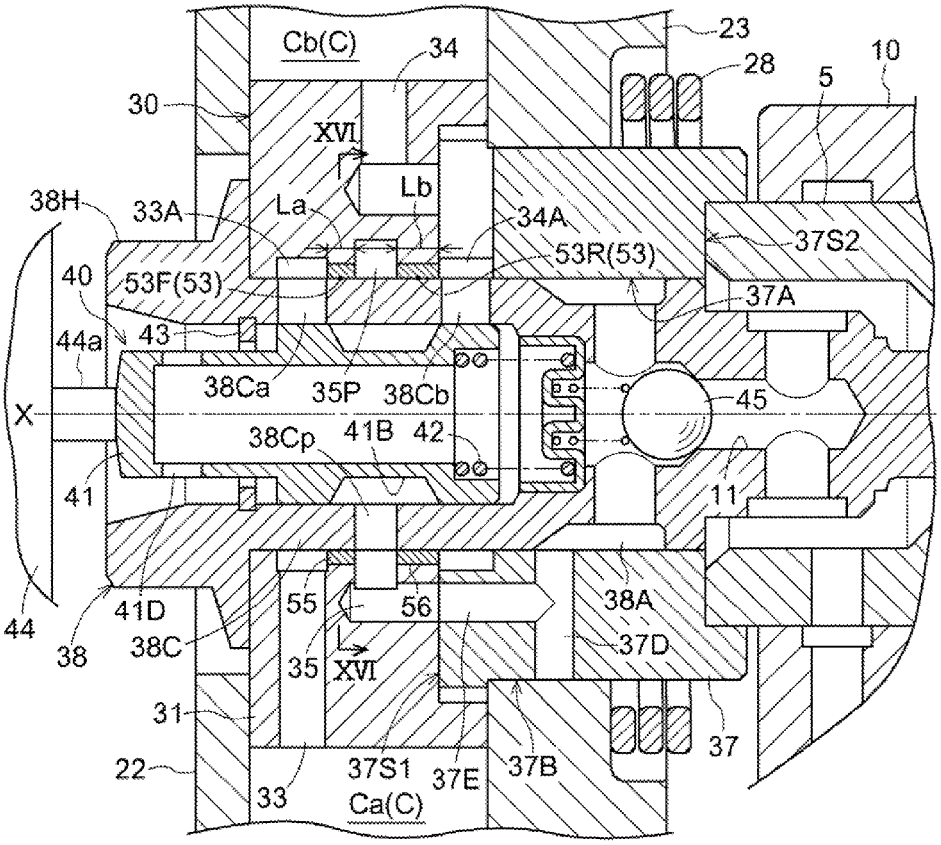
FIG. 15 is a cross-sectional view illustrating a modified example of the clearance communication passage.
Figure 16:
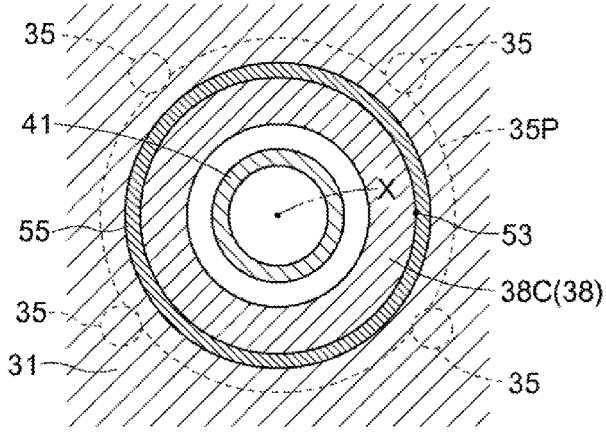
FIG. 16 is a cross-sectional view taken along a line XVI-XVI in FIG. 15.

The clearance communication passage 53 of this modified example is configured by including an advanced angle side bush 55 (an example of a partition member) between the pump flow passages 35 and the advanced angle flow passages 33 at the inner periphery of the inner rotor body 31 and a retarded angle side bush 56 (an example of the partition member) between the pump flow passages 35 and the retarded angle flow passages 34 as illustrated in FIGS. 15 and 16.

Each of the advanced angle side bush 55 and the retarded angle side bush 56 is made of a material including a greater thermal expansion coefficient than that of the connection bolt 38. The advanced angle side bush 55 and the retarded angle side bush 56 are fitted and fixed to the inner periphery of the inner rotor body 31 without a clearance. In a case where the temperature of the hydraulic oil is lower than a set value, the inner periphery of the inner rotor body 31 makes contact with the outer periphery of the connection bolt 38.

In a case where the temperature of the hydraulic oil increases, the clearance advanced angle communication passage 53F appears on a basis of the difference in thermal expansion rates between the advanced angle side bush 55 and the connection bolt 38 and the clearance retarded angle communication passage 53R appears on a basis of the difference in thermal expansion rates between the retarded angle side bush 56 and the connection bolt 38. The clearance advanced angle communication passage 53F and the clearance retarded angle communication passage 53R constitute the clearance communication passage 53.

Accordingly, at the time of low oil temperature, the clearance advanced angle communication passage 53F and the clearance retarded angle communication passage 53R are inhibited from appearing so that the hydraulic oil is not supplied to the advanced angle chambers Ca and the retarded angle chambers Cb. On the other hand, in a case where the temperature of the hydraulic oil increases, the clearance advanced angle communication passage 53F and the clearance retarded angle communication passage 53R are generated to thereby supply the hydraulic oil to the advanced angle chambers Ca and the retarded angle chambers Cb even when the spool 41 is at the neutral position.

Specifically, in the modified example of the clearance communication passage 53, the advanced angle side communication distance La by which the hydraulic oil flows to the clearance advanced angle communication passage 53F and the retarded angle side communication distance Lb by which the hydraulic oil flows to the clearance retarded angle communication passage 53R are specified to be different values from each other. That is, the advanced angle side communication distance La corresponds to a thickness of the advanced angle side bush 55 in a direction along the rotation axis X while the retarded angle side communication distance Lb corresponds to a thickness of the retarded angle side bush 56 in a direction along the rotation axis X.

Even in the modified example, the advanced angle side communication distance La is specified to be smaller than the retarded angle side communication distance Lb (La<Lb) so that a passage resistance obtained when the hydraulic oil flows through the clearance advanced angle communication passage 53F is smaller than a passage resistance obtained when the hydraulic oil flows through the clearance retarded angle communication passage 53R.

In the modified example, only one of the advanced angle side bush 55 and the retarded angle side bush 56 may be provided at the inner periphery of the inner rotor body 31. In this case, an inner peripheral surface of a portion which is not provided with the bush in the inner rotor body 31 is brought to make contact with the outer peripheral surface of the connection bolt 38.

[Communication Passage: Modified Example of Clearance Communication Passage]

According to this modified example, a flow passage in a groove form is obtained by cutting either an inner periphery of the advanced angle side bush 55 or an inner periphery of the retarded angle side bush 56.

Accordingly, the flow passage in a groove form is provided at either the inner periphery of the advanced angle side bush 55 or the inner periphery of the retarded angle side bush 56 so that the supply of the hydraulic oil at least to either the advanced angle chambers Ca or the retarded angle chambers Cb is available even in a case where the temperature of the hydraulic oil is low. In addition, the supplied oil amount may increase with the decrease of viscosity of the hydraulic oil upon increase of the oil temperature.

[Another Embodiment of Communication Passage]

In the embodiment, the communication passage is provided at either the outer side of the connection bolt 38 or the inner side of the inner rotor body 31. Alternatively, a communication passage in a groove form, for example, may be provided at the outer periphery of the connection bolt 38 and a communication passage in a groove form, for example, may be provided at the inner periphery of the inner rotor body 31 so that two kinds of communication passages may be combined to constitute the communication passage.

In addition, in a case where a passage resistance is specified for each of the communication passage supplying the hydraulic oil to the advanced angle flow passage 33 from the pump flow passage 35 and the communication passage supplying the hydraulic oil to the retarded angle flow passage 34 from the pump flow passage 35, a groove portion provided at the outer periphery of the connection bolt 38 or at the inner periphery of the inner rotor body 31 may be formed so that a portion of the groove portion at a side closer to the advanced angle flow passage 33 is deeply formed or a portion of the groove portion at a side closer to the advanced angle flow passage 33 is wider in groove width so as to specify the flow passage resistance.

Effects of the Embodiment

The valve opening and closing timing control apparatus A includes a construction where the hydraulic oil leaks from the advanced angle chambers Ca and the retarded angle chambers Cb. The leakage increases also by a centrifugal force with the rotation of the valve opening and closing timing control apparatus A. The leakage amount of the hydraulic oil is small in a case where the temperature of the hydraulic oil is low and the viscosity of the hydraulic oil is high. The leakage amount of the hydraulic oil increases while the viscosity is decreasing with the increase of the temperature. Accordingly, in a case where the spool 41 is disposed at the neutral position under circumstances where the oil temperature increases, the leakage amount of the hydraulic oil from the advanced angle chambers Ca and the retarded angle chambers Cb increases. As a result, the relative rotational phase fluctuates by the cam fluctuation torque applied from the intake camshaft 5, i.e., flapping is generated.

On the other hand, in the present embodiment, the communication passage is provided at a boundary portion between the inner rotor body 31 and the connection bolt 38 for causing the hydraulic oil from the pump port 38Cp to flow to the advanced angle flow passages 33 or the retarded angle flow passages 34. The amount of hydraulic oil leaking from the advanced angle chambers Ca and the retarded angle chambers Cb is compensated to fill at least either the advanced angle chambers Ca or the retarded angle chambers Cb with the hydraulic oil to thereby restrain flapping of the relative rotational phase by the cam fluctuation torque.

Specifically, even under circumstances where the leakage amount of the hydraulic oil increases because of the decrease of viscosity with the increase of the oil temperature, the amount of hydraulic oil supplied to the advanced angle chambers Ca or the retarded angle chambers Cb via the communication passage increases on a basis of the difference in thermal expansion coefficients. The hydraulic oil for the compensation of the leakage amount is supplied to the advanced angle chambers Ca and the retarded angle chambers Cb to thereby restrain the relative rotational phase from fluctuating.

Further, in the valve opening and closing timing control apparatus A provided at the intake camshaft 5, the cam fluctuation torque is applied in the retarded angle direction Sb. Accordingly, even in a case where the spool 41 is disposed at the neutral position, the hydraulic oil leaks from the advanced angle chambers Ca and the retarded angle chambers Cb to displace the relative rotational phase to the retarded angle direction Sb.

In order to respond to the aforementioned drawbacks, the advanced angle side communication distance La is specified to be smaller than the retarded angle side communication distance Lb or the passage resistance of the first communication passage is made smaller than the passage resistance of the second communication passage. Accordingly, the more hydraulic oil is supplied to the advanced angle chambers Ca than to the retarded angle chambers Cb to thereby restrain the displacement of the relative rotational phase to the retarded angle direction and retrain flapping of the relative rotational phase caused by the cam fluctuation torque.

INDUSTRIAL AVAILABILITY

The present invention is applicable to a valve opening and closing timing control apparatus including a drive-side rotational member and a driven-side rotational member, and including a spool internally mounted to a connection bolt which connects the driven-side rotational member to a camshaft.

EXPLANATION OF REFERENCE NUMERALS

1 crankshaft
5 camshaft (intake camshaft)
20 drive-side rotational member (outer rotor)
30 driven-side rotational member
33 first flow passage (advanced angle flow passage)
34 second flow passage (retarded angle flow passage)
35 supply flow passage (pump flow passage)
35 mounting member (connection bolt)
38C tubular wall portion
38Cp supply port (pump port)
38Ca first port (advanced angle port)
38Cb second port (retarded angle port)
41 spool
51F first communication passage (outer circumferential side advanced angle communication passage)
51R second communication passage (outer circumferential side retarded angle communication passage)
52F first communication passage (inner circumferential side advanced angle communication passage)
52R second communication passage (inner circumferential side retarded angle communication passage)
53F first communication passage (clearance advanced angle communication passage)
53R second communication passage (clearance retarded angle communication passage)
55 partition member (advanced angle side bush)
56 partition member (retarded angle side bush)
Ca advanced angle chambers
Cb retarded angle chambers
E internal combustion engine (engine)
P pump (oil pressure pump)
X rotation axis

The invention claimed is:

1. A valve opening and closing timing control apparatus comprising:

a drive-side rotational member rotating synchronously with a crankshaft of an internal combustion engine;

a driven-side rotational member fixed to a camshaft for opening and closing a valve to integrally rotate with the camshaft;

an advanced angle chamber and a retarded angle chamber defined by the drive-side rotational member and the driven-side rotational member;

a mounting member including a tubular wall portion and being coaxial with the camshaft, the mounting member mounting the driven-side rotational member to the camshaft; and a spool housed within a void which is defined by the tubular wall portion of the mounting member in a reciprocatable manner along an axis of the mounting member, the spool being supplied with a fluid discharged from an outside pump, wherein a first port and a second port are provided at the tubular wall portion of the mounting member, the first port and the second port allowing a fluid to selectively flow to the advanced angle chamber and the retarded angle chamber or flow out from the advanced angle chamber and the retarded angle chamber based on a movement of the spool, a first flow passage connecting the first port and the advanced angle chamber to each other and a second flow passage connecting the second port and the retarded angle chamber to each other are provided at the driven-side rotational member, a thermal expansion coefficient of a material forming the driven-side rotational member is greater than a thermal expansion coefficient of a material forming the mounting member.

2. The valve opening and closing timing control apparatus according to claim 1, wherein a supply port at which a fluid from the pump is supplied to the spool is provided at the tubular wall portion of the mounting member, a supply flow passage in communication with the supply port is provided at the driven-side rotational member, at least one of a first communication passage connecting the supply flow passage and the first flow passage to each other and a second communication passage connecting the supply flow passage and the second flow passage to each other is provided at an outer portion of the mounting member.

3. The valve opening and closing timing control apparatus according to claim 2, wherein at least one of the first communication passage and the second communication passage is provided at an inner peripheral surface of the driven-side rotational member.

4. The valve opening and closing timing control apparatus according to claim 3, wherein at least one of the first communication passage and the second communication passage extends along a rotation axis of the driven-side rotational member, the driven-side rotational member being formed by an extrusion processing of metal.

5. The valve opening and closing timing control apparatus according to claim 2, wherein at least one of the first communication passage and the second communication passage is provided at an outer peripheral surface of the mounting member.

6. The valve opening and closing timing control apparatus according to claim 2, wherein a flow passage resistance of the first communication passage and a flow passage resistance of the second communication passage at an outer portion of the mounting member are different from each other.

7. A valve opening and closing timing control apparatus comprising:

a drive-side rotational member rotating synchronously with a crankshaft of an internal combustion engine;

a driven-side rotational member fixed to a camshaft for opening and closing a valve to integrally rotate with the camshaft;

an advanced angle chamber and a retarded angle chamber defined by the drive-side rotational member and the driven-side rotational member;

a mounting member including a tubular wall portion and being coaxial with the camshaft, the mounting member mounting the driven-side rotational member to the camshaft; and a spool housed within a void which is defined by the tubular wall portion of the mounting member in a reciprocatable manner along an axis of the mounting member, the spool being supplied with a fluid discharged from an outside pump, wherein a first port and a second port are provided at the tubular wall portion of the mounting member, the first port and the second port allowing a fluid to selectively flow to the advanced angle chamber and the retarded angle chamber or flow out from the advanced angle chamber and the retarded angle chamber based on a movement of the spool, a first flow passage connecting the first port and the advanced angle chamber to each other and a second flow passage connecting the second port and the retarded angle chamber to each other are provided at the driven-side rotational member, a partition member is provided between the driven-side rotational member and the mounting member, the partition member being formed of a material including a greater thermal expansion coefficient than a thermal expansion coefficient of a material forming the mounting member.

8. The valve opening and closing timing control apparatus according to claim 7, wherein a supply port at which a fluid from the pump is supplied to the spool is provided at the tubular wall portion of the mounting member, a supply flow passage in communication with the supply port is provided at the driven-side rotational member, at least one of a first communication passage connecting the supply flow passage and the first flow passage to each other and a second communication passage connecting the supply flow passage and the second flow passage to each other is provided at an outer portion of the mounting member.

9. The valve opening and closing timing control apparatus according to claim 8, wherein at least one of the first communication passage and the second communication passage is provided at an inner peripheral surface of the partition member.

* * * * *